US012471649B1

(12) United States Patent
Saavedra

(10) Patent No.: US 12,471,649 B1
(45) Date of Patent: Nov. 18, 2025

(54) GARMENT WITH INTEGRATED MITTEN

(71) Applicant: Manuel Franklin Saavedra, Airdrie (CA)

(72) Inventor: Manuel Franklin Saavedra, Airdrie (CA)

( * ) Notice: Subject to any disclaimer, the term of this patent is extended or adjusted under 35 U.S.C. 154(b) by 0 days.

(21) Appl. No.: 18/919,658

(22) Filed: Oct. 18, 2024

(51) Int. Cl.
*A41D 19/00* (2006.01)
*A41D 19/01* (2006.01)

(52) U.S. Cl.
CPC ..... *A41D 19/0041* (2013.01); *A41D 19/0017* (2013.01); *A41D 19/01* (2013.01)

(58) Field of Classification Search
CPC ..... A41D 19/0017; A41D 19/01; A41D 19/0013; A41D 19/0044; A41D 19/0041; A41D 27/10; A41D 15/00; A41D 15/002; A41D 19/02; A41D 19/0006; A41D 19/001; A41D 19/0157
USPC ..... 2/158, 269, 270
See application file for complete search history.

(56) References Cited

U.S. PATENT DOCUMENTS 2,128,796 A * 8/1938 Bohm-Myro ..... A41D 19/0041 2/158
2,274,335 A * 2/1942 Kennedy ..... A41D 19/01 D2/622
2,323,136 A * 6/1943 Johanson ..... A41D 19/01 2/907
2,603,790 A * 7/1952 Boehm-Myro ..... A41D 19/01 2/160
2,609,543 A * 9/1952 Farrell ..... A41D 19/01 301/105.1
3,299,441 A * 1/1967 Slimovitz ..... A41D 19/0017 D2/622
4,712,253 A 12/1987 Chen
4,741,052 A 5/1988 Rubin
4,756,027 A 7/1988 Buenos et al.
4,944,041 A * 7/1990 Buenos ..... A41D 19/0041 2/84
5,509,143 A * 4/1996 Yates ..... A41D 19/01535 2/160
5,774,894 A * 7/1998 Yates ..... A41D 19/0041 2/160
5,815,837 A 10/1998 Christman et al.
(Continued)

FOREIGN PATENT DOCUMENTS

CA 2269273 A1 * 10/2000 ..... A41D 19/01
GB 187705 A * 10/1922
KR 200236031 Y1 * 10/2001

*Primary Examiner* — Amy Vanatta
(74) *Attorney, Agent, or Firm* — Argus Intellectual Enterprise, LLC; Daniel Enea; Jordan Sworen

(57) ABSTRACT

A garment with a reconfigurable and integrated mitten is provided. The garment includes a sleeve with the integrated mitten disposed at a distal end, wherein the mitten can be selectively used in a plurality of configurations, including a cuff position, a mitten position, and a trigger-finger position. The mitten features a palm panel with an inner and outer palm layer joined via a seam fastener to form a double palm layer. A finger panel is joined to the palm panel and includes a trigger finger hole for receiving one or more fingers of the wearer in the trigger-finger position. The garment is designed for users engaged in outdoor activities requiring both warmth and dexterity, offering the ability to easily transition between configurations for varying environmental conditions.

15 Claims, 5 Drawing Sheets

(56) References Cited

U.S. PATENT DOCUMENTS

| | | | | |
|---|---|---|---|---|
| 6,996,847 | B2 * | 2/2006 | Anderson | A41D 19/0013 2/16 |
| 7,290,291 | B2 | 11/2007 | Anderson et al. | |
| D652,609 | S * | 1/2012 | Walker | D2/621 |
| 8,856,965 | B1 | 10/2014 | Theofield | |
| 11,064,747 | B2 | 7/2021 | Zahradka et al. | |
| 2006/0212989 | A1 * | 9/2006 | White | A41D 19/01588 2/159 |
| 2006/0260022 | A1 * | 11/2006 | Vaughn | A41D 19/01 2/163 |
| 2012/0042436 | A1 * | 2/2012 | Jenkin | A41D 19/0013 2/158 |
| 2013/0133122 | A1 | 5/2013 | LaFlamme | |
| 2014/0082825 | A1 * | 3/2014 | Clark | A41D 19/01 2/158 |
| 2016/0249694 | A1 * | 9/2016 | Sullivan | A41D 19/0048 2/158 |
| 2017/0231302 | A1 | 8/2017 | Rhodes | |
| 2020/0000160 | A1 | 1/2020 | Dunn et al. | |
| 2024/0164456 | A1 | 5/2024 | Margetts | |

* cited by examiner

GARMENT WITH INTEGRATED MITTEN

BACKGROUND OF THE INVENTION

The present invention relates to garments with integrated hand coverings, more specifically to garments that feature reconfigurable mittens integrated into the sleeve. These garments are designed to offer both warmth and dexterity to users engaged in outdoor activities such as hunting, photography, and sports.

In the current market, several types of garments are available that provide some level of warmth and hand protection. These include traditional base layers, gloves, mittens, and windbreakers. Base layers are typically worn under outer clothing to retain body heat and wick moisture away from the skin. However, standard base layers do not cover the entire hand, leaving the hands exposed to cold temperatures. As a result, individuals often rely on separate gloves or mittens to keep their hands warm.

Gloves and mittens, while effective in providing warmth, present their own set of challenges. Gloves allow for individual finger movement which makes them suitable for activities that require dexterity. However, gloves often fail to provide sufficient warmth, especially in extremely cold conditions. Mittens, on the other hand, offer better insulation by grouping the fingers together, but they significantly reduce the wearer's ability to perform tasks that require precision, such as pulling a trigger or operating a camera. Regarding both mittens and gloves, these accessories often terminate at the wrist of the wearer, forming a gap between the garment and mitten/gloves. This gap can expose the skin to the elements and allow moisture to enter therebetween.

Another significant drawback of existing solutions is the inconvenience associated with using separate removable gloves or mittens. Users often forget to bring their gloves or misplace one or both of them, thereby leaving their hands vulnerable to the cold. Removable mittens, for instance, can be easily lost, and integrated hand warmers may not provide sufficient warmth or coverage for extended periods in cold environments.

Traditional gloves and mittens can be cumbersome to put on and take off, especially in situations where quick adjustments are necessary. For example, hunters may need to quickly expose their trigger finger for precise shooting, but conventional mittens do not provide this functionality requiring the user to remove the entire mitten. Thus, the donning and doffing of mittens expose the hand to cold air. Some garments attempt to address these issues by incorporating features such as having extending sleeves with holes to receive a thumb therethrough. However, these designs often lack the flexibility, durability, and ease of use required for outdoor activities.

The present invention addresses these shortcomings by providing a garment with a reconfigurable mitten that is integrated into the sleeve. This integrated mitten is capable of transitioning between several configurations, including a cuff position, a mitten position, an over-thumb cuff position, and a trigger-finger position. By incorporating a reconfigurable design, the mitten remains an integral part of the garment, preventing loss or misplacement. The integrated mitten is designed to allow the user to transition between configurations quickly, providing warmth and protection when needed, while also offering access to the trigger finger or other digits for tasks requiring precision and dexterity. The mitten's double-layered construction further enhances insulation, ensuring that the user stays warm in colder conditions. The ability to shift between configurations, such as folding the mitten into the sleeve cuff or exposing the thumb through a thumb hole, allows the garment to meet the dynamic needs of outdoor enthusiasts.

In light of the devices disclosed in the known art, it is submitted that the present invention substantially diverges in design elements and methods from the known art and consequently it is clear that there is a need in the art for an improvement for a garment with integrated mitten. In this regard the instant invention substantially fulfills these needs.

SUMMARY OF THE INVENTION

In view of the foregoing disadvantages inherent in the known types of garments now present in the known art, the present invention provides a garment with a reconfigurable and integrated mitten that can transition between various configurations, including a cuff position, a mitten position, an over-thumb cuff position, and a trigger-finger position. The mitten is integrated into the sleeve and includes features such as a built-in trigger finger hole, double-layered construction for enhanced warmth, and a thumb sleeve that can be repositioned between a stored and working position. The garment offers superior warmth, functionality, and convenience for users engaged in activities that require precise finger movements, such as hunting, photography, and sports, while allowing quick transitions between different configurations without the need for separate mittens or gloves.

It is an objective of the present invention to provide a garment with a reconfigurable and integrated mitten that provides versatile hand coverage, allowing the user to quickly transition between multiple configurations. This is achieved by integrating the mitten directly into the sleeve, allowing it to be selectively used in various positions, such as a cuff position, a mitten position, and a trigger-finger position.

It is an objective of the present invention to provide a garment with a reconfigurable and integrated mitten that maintains warmth and protection in cold environments while allowing for precise manual dexterity. The mitten's double-layered construction ensures that the user's hands remain insulated without compromising the ability to perform detailed tasks.

It is an objective of the present invention to provide a garment with a reconfigurable and integrated mitten that eliminates the need for separate mittens or gloves, reducing the risk of loss and the inconvenience of carrying additional hand coverings. By incorporating the mitten into the garment, the invention simplifies the user experience and ensures the mitten is always readily accessible when needed.

It is an objective of the present invention to provide a garment with a reconfigurable and integrated mitten that provides enhanced usability in dynamic outdoor activities. The mitten can easily transition between positions to meet the specific needs of activities such as hunting, photography, or sports.

It is therefore an object of the present invention to provide a new and improved garment with a reconfigurable and integrated mitten that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
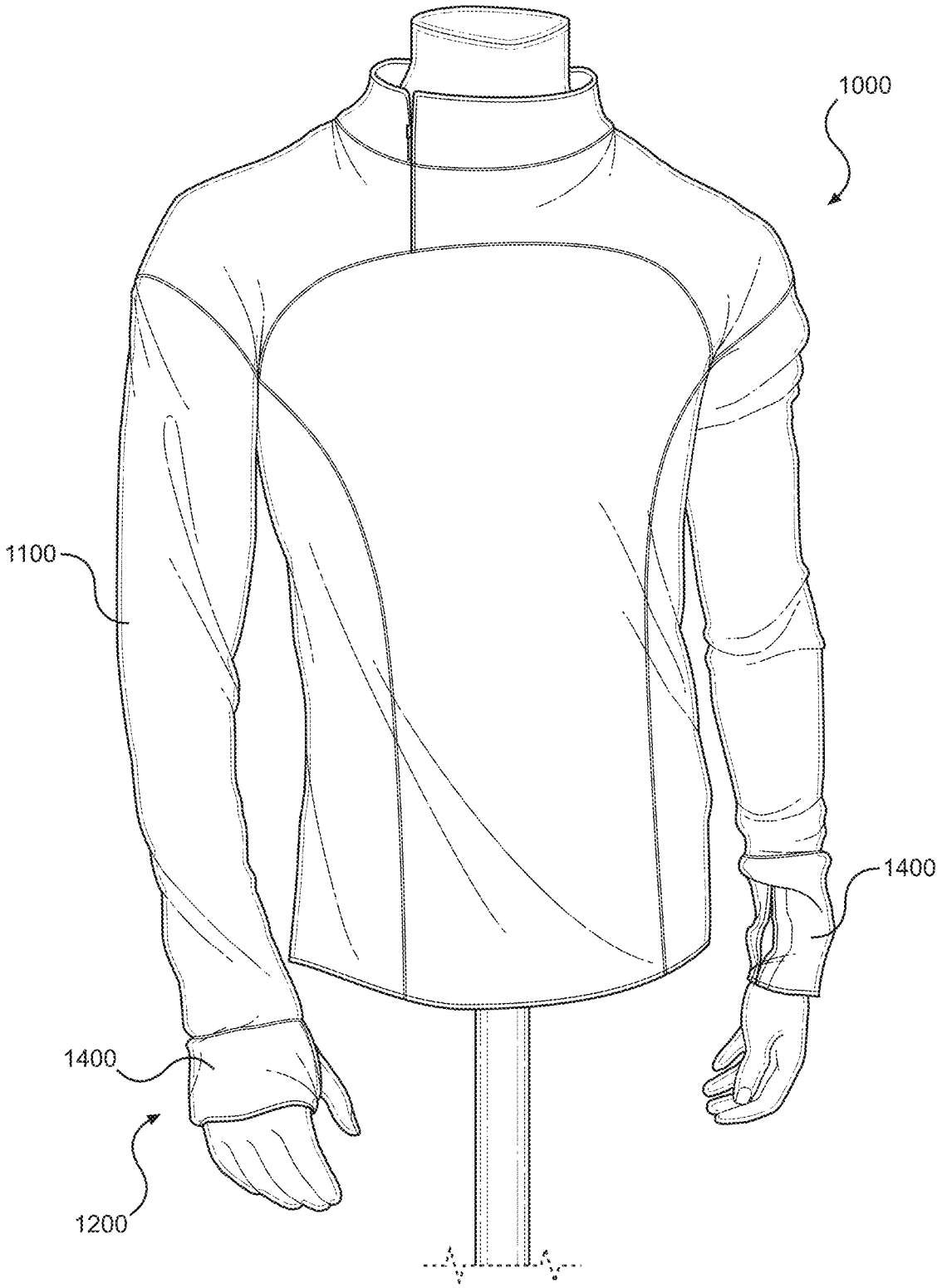
FIG. 1 shows a perspective view of a garment with a reconfigurable and integrated mitten.

Reference is made herein to the attached drawings. Like reference numerals are used throughout the drawings to depict like or similar elements of the garment. For the purposes of presenting a brief and clear description of the present invention, the preferred embodiment will be discussed as used for outdoor activities that require both warmth and dexterity, such as hunting, photography, and sports. The figures are intended for representative purposes only and should not be considered to be limiting in any respect.

As used herein, the term "garment" refers to any article of clothing designed to cover and protect the body or portions thereof. The term is intended to encompass a wide range of clothing items, including but not limited to full-body garments such as jackets, coats, shirts, and base layers, as well as partial-body garments such as arm sleeves and wraps. The term "garment" is also meant to include items that may cover specific parts of the body, such as arm sleeves without torso coverings, leg warmers, or protective sleeves for various activities. The term extends to garments made from various materials, including natural fibers (e.g., wool, cotton), synthetic fibers (e.g., polyester, nylon), or a combination thereof. Additionally, the garment may incorporate specialized features such as zippers, pockets, adjustable fasteners, or integrated accessories, depending on the intended use and design.

As used herein, the term "mittens" refers to any type of hand covering designed to provide warmth and protection for the user's hands. The term is intended to include traditional mittens, which enclose all fingers together in a single compartment, as well as gloves, which provide individual compartments for each finger. Additionally, the term "mittens" encompasses hybrid hand coverings, such as fingerless gloves, convertible mittens that can be transformed into fingerless gloves, mittens with segmented compartments (e.g., a separate compartment for the thumb and the remaining fingers), and any other variations that cover the hand or portions thereof. The mitten may be made from various materials, including but not limited to natural fibers (e.g., wool, leather) and synthetic fibers (e.g., fleece, neoprene). The term also includes mittens with specialized features, such as trigger finger holes, windbreaker covers, thermal insulation, waterproofing, or other enhancements designed to improve functionality and user comfort.

As used herein, the term "integrated mitten" refers to a mitten that is formed as part of the garment, either made from the same continuous clothing panel or joined to the garment via a seam or other fastening means. An integrated mitten may be constructed as an extension of the sleeve or another part of the garment, providing a seamless transition from the garment to the mitten. This integration ensures that the mitten is always attached to the garment to eliminate the risk of loss and simplifying the process of deploying or retracting the mitten when needed.

Referring now to FIG. 1, there is shown a perspective view of a garment with a reconfigurable and integrated mitten. The garment 1000 is depicted as a long-sleeve shirt for a man, although it can be designed as a unisex garment or tailored for male or female wearers. The garment 1000 provides a versatile solution for outdoor activities requiring both warmth and manual dexterity. In the shown embodiment, the garment 1000 includes sleeves 1100 with integrated mittens 1200 disposed at the distal ends thereof.

Figure 7:
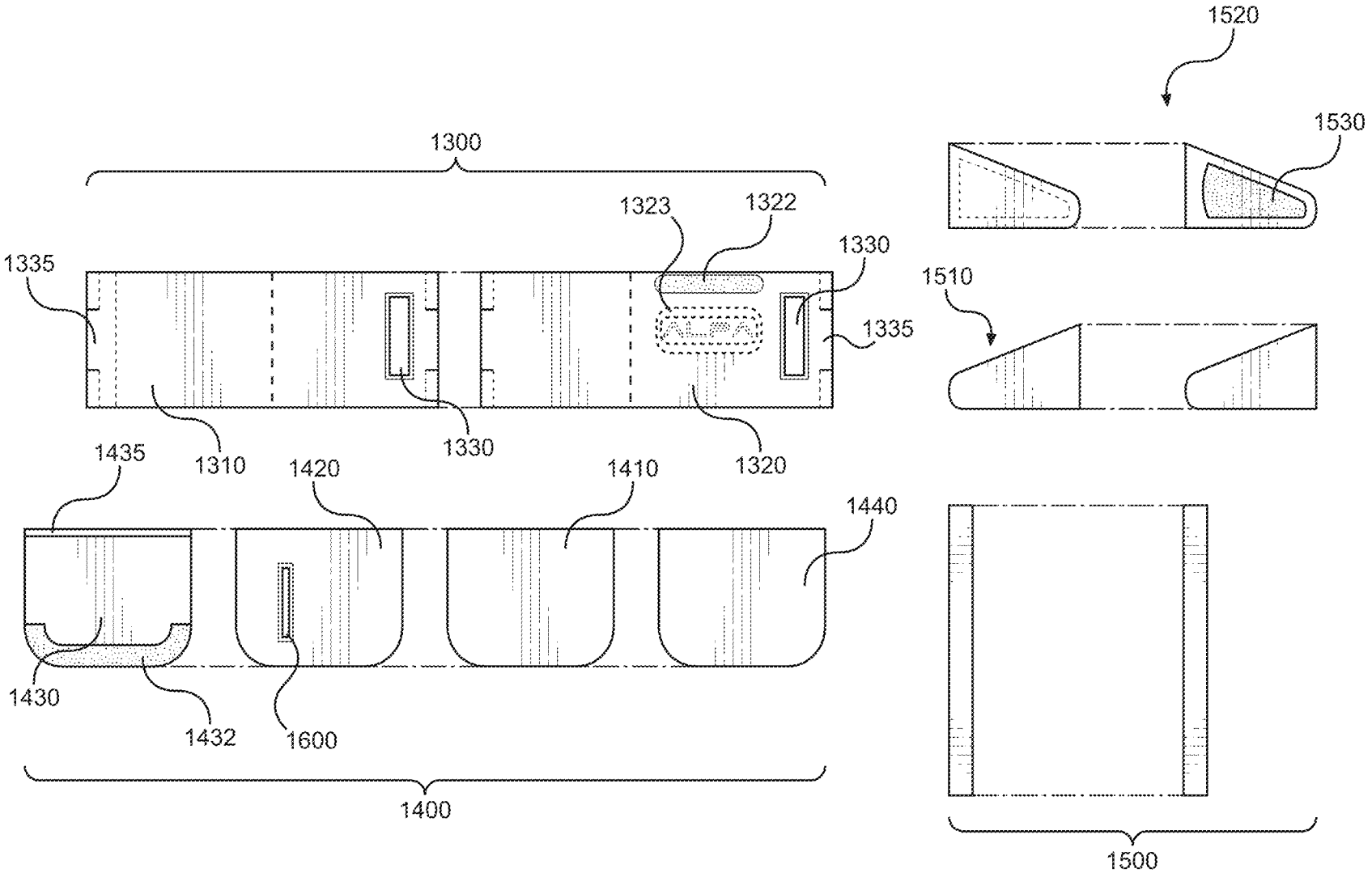
FIG. 7 shows a plan view of the panels of the mitten before they are sewn together, illustrating the structure, elastic, Velcro, and openings, including the layer positioned against the user's skin and the double layer used in the mitten mode.

In the shown embodiment, the mitten 1200 is configured to be selectively used in a plurality of configurations, including the cuff position, the mitten position, and the trigger-finger position. The mitten is designed to be worn on the hand of the user-wearer, while the sleeve is worn on the forearm portion. The mitten 1200 comprises a palm panel 1300, which includes an inner palm layer and an outer palm layer, as shown in FIG. 7. These layers are joined via a seam fastener, forming a double palm layer for added warmth and durability. The palm panel 1300 is securely joined to the sleeve 1100 at the proximal end and to a finger panel 1400 at the distal end. The finger panel 1400 comprises multiple layers, including a first inner finger layer, a second inner finger layer, a first outer finger layer, and a second outer finger layer. In alternative embodiments, the palm panel and finger panel 1300, 1400 comprise any number of layers. The layers are stacked to provide additional thermal protection.

In one embodiment, the second outer finger layer of the finger panel 1400 is configured to be repositionable over the user's fingertips to transition between the cuff and mitten positions. Additionally, the finger panel 1400 includes a trigger finger hole (shown in FIGS. 6A and 6B), which allows the user-wearer to extend one or more fingers through the hole in the trigger-finger position, providing necessary dexterity for handling precision tools while maintaining warmth for the rest of the hand.

In FIG. 1, the right hand of the of the user corresponds to the right side of the garment 1000 is shown in the over-thumb cuff position, wherein the thumb is inserted through a thumb hole in the palm panel 1300 while the finger panel 1400 remains folded back to expose the fingers. The left hand is depicted in the cuff position, wherein the finger panel 1400 is folded back to expose the entire hand for maximum dexterity.

Figure 2A:
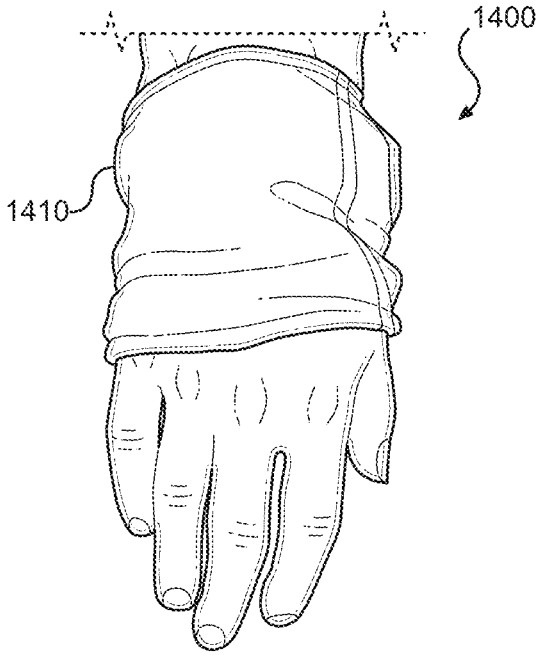
FIG. 2A shows an overhead view of the dorsal side of the hand with the mitten in the cuff mode, where the finger panel is folded back exposing the user's fingertips.
Figure 2B:
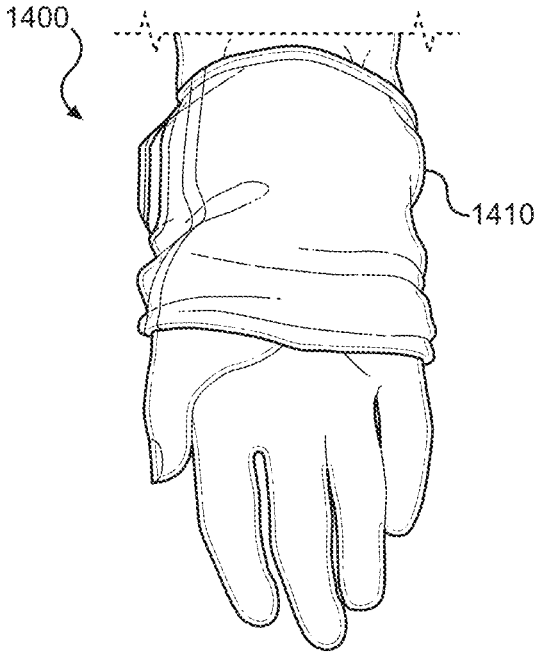
FIG. 2B shows an overhead view of the palmar side of the hand in the cuff mode.

Referring now to FIGS. 2A and 2B, there is a shown overhead view of the dorsal side of the hand with the mitten in the cuff mode and an overhead view of the palmar side of the hand in the cuff mode, respectively. As used herein the term "palm side" or "palmar side" refers to the front side of the hand, commonly known as the palm, which includes the pads of the fingers, the thumb, and the palm surface. This is the side of the hand that typically contacts objects when gripping or holding. In contrast, the term "dorsal side," as seen in FIG. 2B, refers to the back side of the hand, opposite the palm. The dorsal side includes the knuckles and the back of the fingers and thumb, and it is the surface that faces outward when the hand is in a natural, palm-down position.

In the shown embodiment, the inner palm layer and outer palm layer of the palm panel are joined together by a seam fastener to form a double palm layer. The finger panel 1400 is folded back onto itself, thereby exposing the first inner finger layer 1410. As shown, the user's fingertips are exposed which allows the wearer to perform tasks requiring precise finger movements. The thumb remains uncovered, providing full freedom of movement. The seam fasteners along the palm and finger panels maintain the structural integrity of the mitten while it is in this folded-back configuration. The thumb sleeve (shown in FIG. 4A) is not deployed in this configuration, and the thumb remains exposed. This position allows the user to fully utilize their hand without interference from the mitten.

Figure 3A:
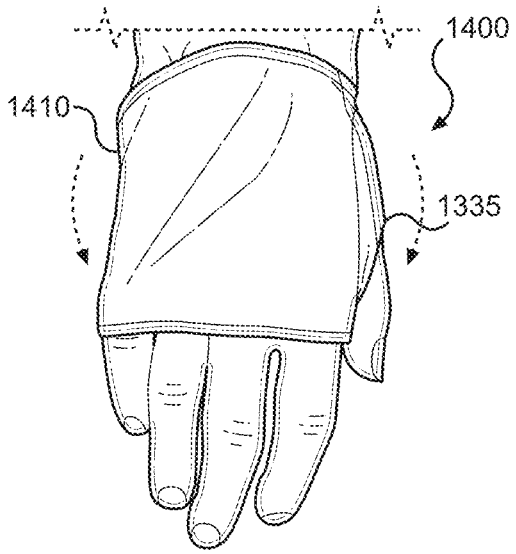
FIG. 3A shows an overhead view of the dorsal side of the hand with the mitten in the over-thumb cuff mode, where the thumb is received through the thumb hole while the finger panel is folded back.
Figure 3B:
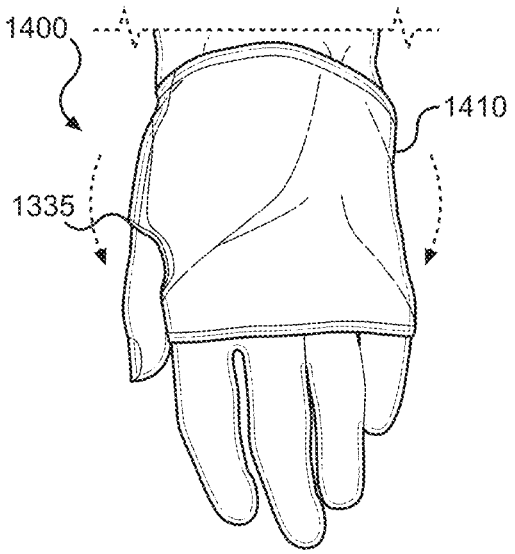
FIG. 3B shows an overhead view of the palmar side of the hand in the over-thumb cuff mode.

Referring now to FIGS. 3A and 3B, there is shown an overhead view of the dorsal side of the hand with the mitten in the over-thumb cuff mode, where the thumb is received through the thumb hole while the finger panel is folded back and an overhead view of the palmar side of the hand in the over-thumb cuff mode. In FIG. 3A, which shows the dorsal side of the hand, the thumb is visible extending through the thumb slot 1335. The rest of the mitten, including the folded finger panel 1400, remains positioned on the back of the hand, with the second outer finger layer folded back to form a cuff. The thumb remains free while the hand and wrist are partially covered by the double-layered palm panel, offering warmth and comfort. This configuration is useful for situations where the thumb is needed for precise movements, but partial coverage of the hand is still desired. In FIG. 3B, the thumb slot 1335 in both the inner and outer palm layers can be seen, with the thumb inserted through the opening. In one embodiment, the thumb hole 1335 is reinforced with elastic material to ensure a snug fit around the thumb while maintaining flexibility.

In both configurations shown in FIGS. 2A-3B, the seam fasteners joining the inner and outer palm layers and finger layers ensure the mitten maintains its structure and allows for smooth transitions between various positions. The use of elastic edges around the thumb slot 1335 allows for quick transitions between covered and uncovered thumb positions while providing a secure and flexible fit.

Figure 4A:
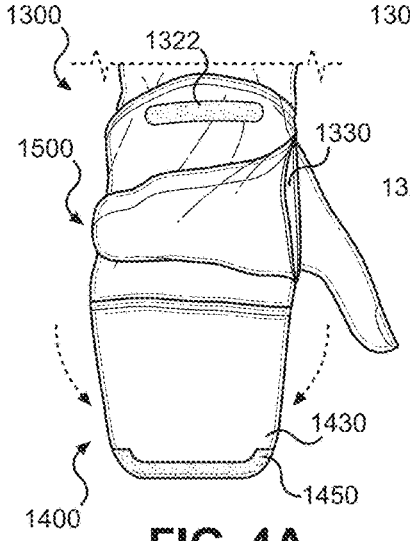
FIG. 4A shows an overhead view of the dorsal side of the hand in the mitten mode.

Referring now to FIGS. 4A-5C there is shown an overhead view of the dorsal and palmar side of the hand in the mitten mode, an overhead view of the dorsal and palmar side of the hand in the mitten mode, with the second outer finger layer covering the fingertips for warmth, and an overhead view of the dorsal and palmar side of the hand with the mitten fully deployed in the mitten mode, respectively. In the shown embodiment, the mitten is transitioning from the partial mitten position shown in FIGS. 4A and 5A to the mitten position or full mitten position in FIGS. 4C and 5C. In FIGS. 4A and 5A, the mitten 1200 is in the partial mitten position, with the finger panel 1400 extended over the fingertips to fully enclose the fingers for warmth. The finger panel 1400, which includes the first and second inner and outer finger layers, is no longer folded back but rather deployed to cover the entire hand. The second outer finger layer 1430 is attached along the fingertip seam, ensuring that the fingers are enclosed and insulated. The thumb sleeve 1500 remains folded in its stored position, as the thumb is not yet covered. As shown in FIG. 5A, the palm panel 1300 creates a double layer that provides enhanced insulation. The finger panel 1400 is fully deployed, covering the user's fingers, while the thumb sleeve remains in the stored position.

Figure 4B:
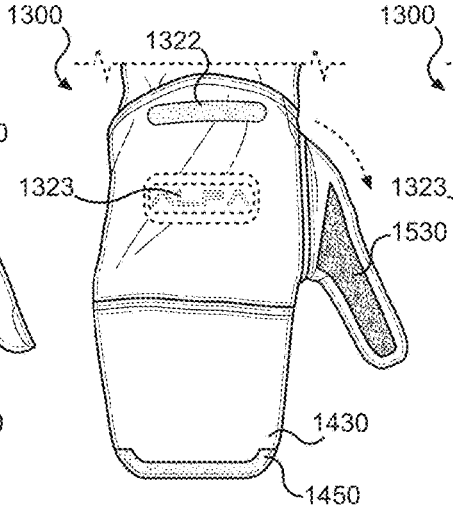
FIG. 4B shows an overhead view of the dorsal side of the hand in the mitten mode, with the second outer finger layer covering the fingertips for warmth.
Figure 5A:
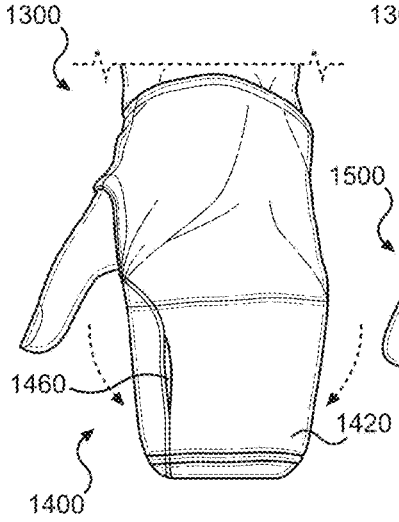
FIG. 5A shows an overhead view of the palmar side of the hand in the mitten mode.
Figure 5B:
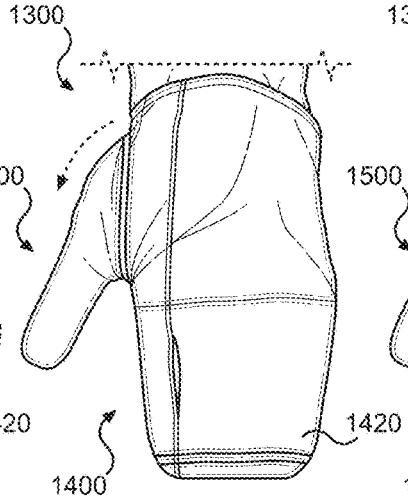
FIG. 5B shows an overhead view of the palmar side of the hand in the mitten mode, illustrating full hand coverage.

As shown in FIGS. 4B and 5B, the thumb sleeve 1500 is deployed in its working position to fully covering the thumb. The thumb sleeve 1500 comprises an inner thumb layer and an outer thumb layer and is configured to provide additional insulation to protect the thumb from cold weather. The seam fasteners joining these layers form a durable, double-layered structure. The elastic edges around the thumb sleeve 1500 ensure a snug fit while maintaining flexibility. This configuration allows the entire hand, including the thumb, to remain enclosed within the mitten for warmth. The thumb sleeve 1500 is held in the stored positions between the palm panel and finger panel 1300, 1400 in FIGS. 2A and 2B. The thumb sleeve 1500 is exposed in FIG. 4A. In the shown embodiment, the thumb sleeve 1500 is partially connected to the palm panel, wherein the thumb sleeve 1500 is open to receive the thumb through the thumb hole 1330. The ability to transition the thumb sleeve 1500 between stored and working positions allows the mitten to adapt to various weather conditions and activity levels.

Figure 4C:
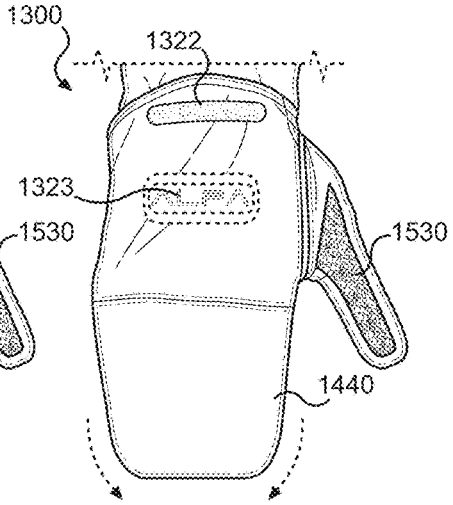
FIG. 4C shows an overhead view of the dorsal side of the hand with the mitten fully deployed in the mitten mode.
Figure 5C:
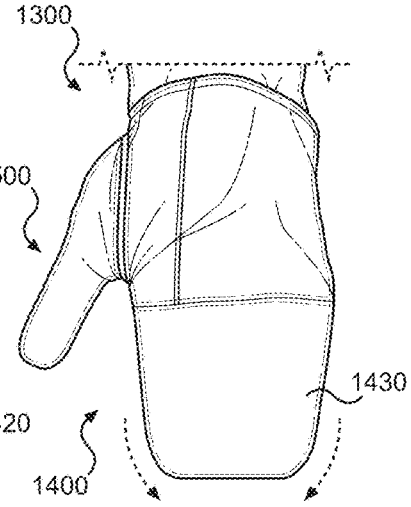
FIG. 5C shows an overhead view of the palmar side of the hand in the mitten mode with the thumb sleeve deployed.

As shown in FIGS. 4C and 5C, the mitten is transitioning to the full mitten mode, with the second outer finger layer 1430 securely covering the fingertips, while the thumb remains covered by the thumb sleeve 1500. The second outer finger layer 1430 has been repositioned over the fingertips for full hand protection. The finger panel 1400 remains fully extended, covering the entire hand and offering maximum warmth.

As shown in FIGS. 4A, 4B, 5A, and 5B, the first inner finger layer 1420 is shown against the skin of the user in a single layer. The second outer layer 1430 is shown over the first outer finger layer 1410 (not shown) and the second inner finger layer 1440 in a temporary triple layer, until FIGS. 4C and 5C, wherein the second outer finger layer 1430 is folded over the fingertips.

Figure 6B:
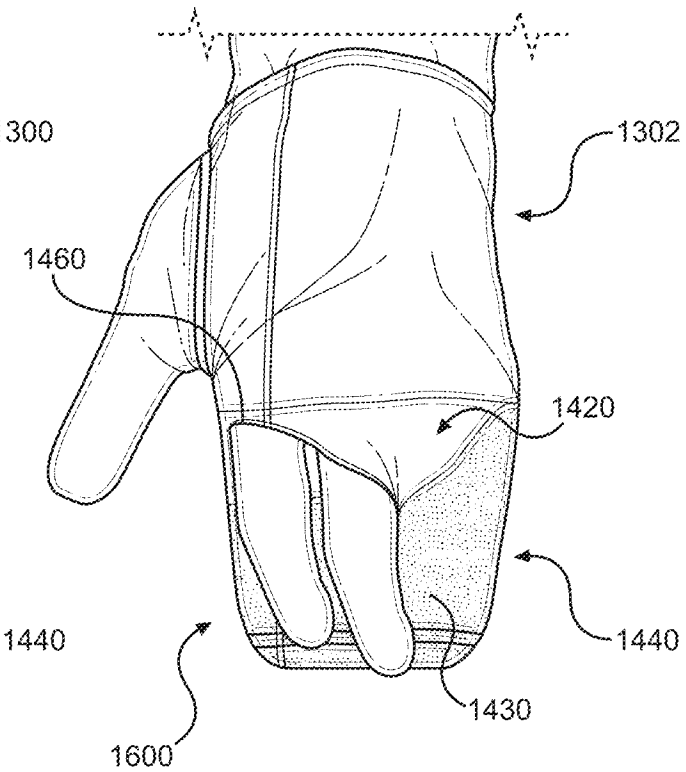
FIG. 6B shows an overhead view of the palmar side of the hand with two fingers extended through the trigger finger hole.
Figure 6A:
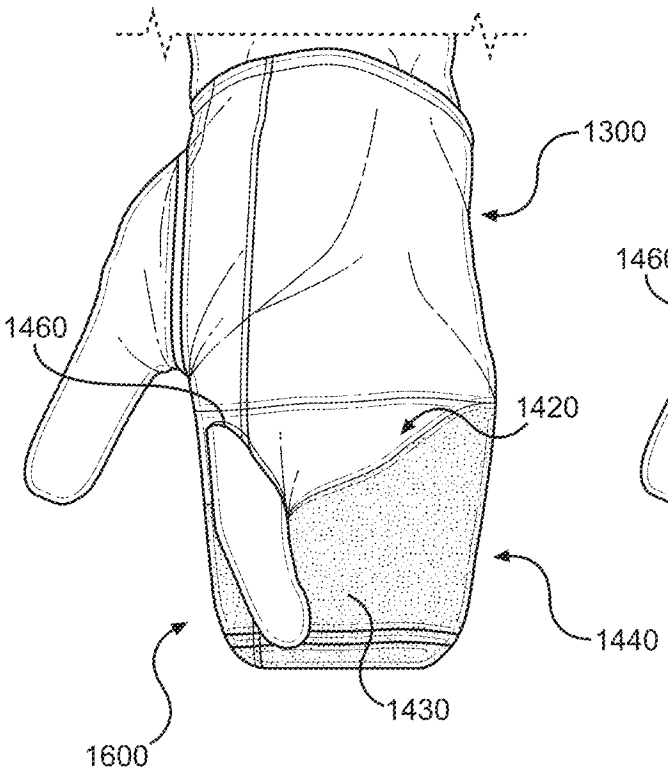
FIG. 6A shows an overhead view of the palmar side of the hand with one finger extended through the trigger finger hole.

Referring now to FIGS. 6A and 6B, shows an overhead view of the palmar side of the hand with one finger extended through the trigger finger hole and an overhead view of the palmar side of the hand with two fingers extended through the trigger finger hole, respectively. As shown in the embodiment of FIG. 6A, the finger panel, which includes a first inner finger layer, second inner finger layer, first outer finger layer, and second outer finger layer, remains deployed over the remaining fingers, keeping them insulated. The trigger finger hole 1600 minimizes heat loss while allowing for full movement and precision. This configuration is particularly useful in activities requiring detailed finger work, such as pulling a trigger, operating a camera, or using a cell phone, while the rest of the hand remains covered for warmth. In the shown embodiment, there is a 0.5 inch overlap between thumb hole and trigger finger hole 1600. However, in alternative embodiments, the overlap may be larger or smaller as needed to cover the hole. In some embodiments, the trigger finger hole 1600 is the same hole as the thumb slot (1335, FIGS. 3A, 3B, and 7), specifically the thumb slot 1335 of the outer layer.

In FIG. 6B, the palmar side of the hand is again depicted, but this time with two fingers extended through the trigger finger hole. In one embodiment, an elastic-lined opening adjusts to securely accommodate both fingers, providing dexterity while maintaining warmth for the rest of the hand. The second outer finger layer continues to cover the other fingers, ensuring that the hand remains insulated. The thumb remains enclosed in the thumb sleeve, which is in the working position, providing full coverage of the thumb.

In both FIGS. 6A and 6B, the trigger finger position allows the user to extend one or more fingers through the trigger finger hole while the rest of the mitten remains deployed in the mitten mode. The use of elastic around the trigger finger hole 1600 ensures that the exposed fingers remain mobile and precise without sacrificing warmth in the rest of the hand. In the shown embodiment, the second outer finger layer 1430 is moved towards the fingertips to expose the trigger finger hole 1600 more fully. In this way, the fingers of the user are exterior the mitten.

In one embodiment, the finger panel 1400 includes an overlap material 1460 that is configured to cover the trigger finger hole when the mitten is in the mitten mode. The overlap material 1460 is designed to protect the trigger finger opening when it is not in use, ensuring that the hand remains fully insulated. In FIGS. 6A and 6B, where one or two fingers are extended through the trigger finger hole, the overlap material 1460 is repositioned to the side, exposing the opening to allow for finger movement and dexterity. The overlap material 1460, when not in use, seamlessly covers the trigger finger hole, providing additional protection against wind and cold. This flexible fabric is attached to the finger panel with seam fasteners, allowing it to be easily repositioned as the mitten transitions between configurations. This feature makes the garment particularly well-suited for activities that require intermittent use of fingers for precision tasks while keeping the hand protected from the cold.

In the shown embodiment, the symmetry and dimensions between the finger panel 1400 and palm panel 1300 is shown as generally the same for the functional adaptability of the mitten. The symmetrical design ensures that the mitten can accommodate transitions between the different positions, including the trigger-finger position and the over-thumb cuff position, without compromising fit or comfort. The thumb slot 1335, which allows for the thumb to protrude in the over-thumb cuff position, must align properly with the trigger finger hole 1600 to enable the user to easily transition between configurations. This symmetry ensures that the hand can perform precise movements, such as using a trigger or other fine motor tasks, while protecting the hand from exposure to the elements. The symmetrical construction of the finger and palm panels allows for a consistent distribution of material and tension, ensuring that the mitten fits securely around the user's hand, regardless of whether the thumb or fingers are engaged in the mitten's various positions.

Referring now to FIG. 7, there is shown a plan view of the mitten panels before they are sewn together. This figure illustrates the individual components that make up the mitten, including the palm panel 1300, the finger panel 1400, and the thumb sleeve 1500. The palm panel 1300 comprises the inner palm layer 1310 and an outer palm layer 1320, wherein the layers comprise a soft, moisture-wicking material like wool or fleece to provide comfort and warmth. The inner palm layer 1310 is adapted to rest against the user's skin when the garment is worn. The outer palm layer 1320 is the exterior layer, designed to provide additional durability and protection. Both layers are joined by seam fasteners around the edges, ensuring the mitten maintains its structure. The seam fasteners may include stitching, adhesive bonding, or other methods, depending on the materials used. Both palm layers 1310, 1320 comprise the thumb hole 1330 and the thumb slot 1335 which is adapted to receive the thumb of the user-wearer therethrough. The thumb slot 1335 is formed by the joining of the lateral sides of each respective layer to form the slot 1335. The thumb slot 1335 of each layer 1335 overlaps with each other in the over-thumb cuff position. Additionally, the palm layers 1310, 1320 comprise an overlap area 1340 adjacent to the thumb hole 1330 to partially or wholly cover the thumb hole 1330 when not in use.

In the shown embodiment, the finger panel 1400 comprises multiple layers, including the first inner finger layer 1410, the second inner finger layers 1420, the first outer finger layer 1430, and the second outer finger layers 1440. A fingertip seam at the distal end of the finger panel is where the second outer finger layer 1440 can be folded back or deployed, depending on the mitten's configuration. In the shown embodiment, the trigger finger hole 1600 is disposed on the second inner finger layer. The first outer finger layer 1430 includes a fastener 1432 disposed at the fingertip end that is adapted to hold the first outer finger layer 1430 over the finger on the palm side in the mitten position. The fastener 1432 is configured to engage with the mitten or a fastener disposed on the mitten. In one embodiment, the fastener 1432 is adapted to engage a fastener 1322 on the outer palm layer 1320. The first outer finger layer 1430 also includes an elastic member 1435 to keep the layer close to the hand of the user in the mitten position.

In one embodiment, the thumb sleeve 1500 includes an inner thumb layer 1510 and an outer thumb layer 1520, which are joined via seam fasteners to form the double-layered thumb sleeve when assembled. Since the thumb sleeve 1500 is generally tubular, the layers are each formed by two or more thumb panels. The outer thumb layer 1520 comprises a thumb fastener 1530 adapted to keep the thumb sleeve 1500 in the stored position, wherein the thumb fastener 1530 is adapted to selectively couple to a fastener 1323 of the palm panel 1300. In one embodiment, the fasteners 1530, 1323 are hook and loop fasteners or mating fasteners used to secure the thumb sleeve in the stored position. These fasteners ensure the thumb sleeve can be repositioned as needed without compromising the mitten's structure or warmth.

The plan view in FIG. 7 illustrates how the various panels and elements are designed to be assembled into the full mitten structure, as seen in the previous figures. The placement of the seam fasteners, elastic elements, and fasteners enable the mitten to transition smoothly between the cuff position, mitten mode, over-thumb cuff position, and trigger-finger position, while maintaining warmth, flexibility, and durability It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment with a reconfigurable and integrated mitten, comprising:

a sleeve with the reconfigurable and integrated mitten disposed at a distal end thereof;

wherein the mitten is configured to be selectively used in a plurality of configurations, including a cuff position, a mitten position, and a trigger-finger position;

wherein the mitten is configured to be worn on a hand of a user-wearer and the sleeve is configured to be worn on a forearm portion of the user-wearer;

wherein the mitten comprises a palm panel having an inner palm layer and an outer palm layer, wherein the inner and outer palm layers are joined via a seam fastener to form a double palm layer;

wherein the palm panel is joined to the sleeve at a proximal end and to a finger panel at a distal end;

wherein the finger panel comprises a first inner finger layer, a second inner finger layer, a first outer finger layer, and a second outer finger layer;

wherein the second outer finger layer is repositionable over fingertips of the user-wearer to transition between the cuff position and the mitten position;

wherein the finger panel is folded over the palm panel in the cuff position;

wherein the finger panel comprises a trigger finger hole configured to receive one or more fingers of the user-wearer therethrough in the trigger-finger position.

2. The garment with a reconfigurable and integrated mitten of claim 1, wherein the mitten is further configured to be selectively used in an over-thumb cuff position, wherein a thumb slot in the inner and outer palm lavers is configured to receive a thumb of the user-wearer.

3. The garment with a reconfigurable and integrated mitten of claim 2, wherein the finger panel is folded down from the palm panel in the over-thumb cuff position.

4. The garment with a reconfigurable and integrated mitten of claim 3, wherein in the over-thumb cuff position, the inner and outer palm layers each include overlap material to cover the thumb slot and provide lateral access to the thumb slot.

5. The garment with a reconfigurable and integrated mitten of claim 2, wherein the second outer finger layer is joined via a seam fastener along a fingertip seam, and wherein the second outer layer is adapted to transition between the over-thumb cuff position and a partial mitten position, wherein a thumb sleeve is disposed over the palm panel.

6. The garment with a reconfigurable and integrated mitten of claim 1, further comprising a thumb sleeve disposed on an exterior side of the outer palm layer, wherein the thumb sleeve is adapted to reposition between a stored position and a working position.

7. The garment with a reconfigurable and integrated mitten of claim 6, wherein, in the working position, the thumb sleeve comprises an opening adjacent to a thumb hole in the palm panel, and wherein the thumb sleeve is configured to receive a thumb therein.

8. The garment with a reconfigurable and integrated mitten of claim 6, wherein, in the mitten position, the thumb sleeve is configured to provide access to the thumb and the second outer layer is configured to be disposed over the fingertips of the user-wearer.

9. The garment with a reconfigurable and integrated mitten of claim 6, wherein the thumb sleeve comprises an inner thumb layer and an outer thumb layer, wherein the inner and outer thumb layers are joined via a seam fastener to form a double-layered thumb sleeve.

10. The garment with a reconfigurable and integrated mitten of claim 6, wherein the thumb sleeve comprises a first mating fastener configured to removably fasten to a second mating fastener disposed on the exterior side of the outer palm layer to hold the thumb sleeve in the stored position.

11. The garment with a reconfigurable and integrated mitten of claim 10, wherein the first and second mating fasteners are selected from the group consisting of magnetic fasteners, hook-and-loop fasteners, and snap fasteners.

12. The garment with a reconfigurable and integrated mitten of claim 1, wherein the seam fastener joining the inner and outer palm layers is selected from the group consisting of stitching, adhesive bonding, thermal bonding, and ultrasonic welding.

13. The garment with a reconfigurable and integrated mitten of claim 1, further comprising an elastic element disposed along an edge of the finger panel, configured to provide a snug fit around the fingertips in the mitten position.

14. The garment with a reconfigurable and integrated mitten of claim 1, wherein the mitten further comprises a wind-resistant outer shell that is selectively deployable over the finger panel and thumb sleeve to provide additional protection against wind and moisture.

15. A garment with a reconfigurable and integrated mitten, comprising:

a sleeve with the reconfigurable and integrated mitten disposed at a distal end thereof;

wherein the mitten is configured to be selectively used in a plurality of configurations, including a cuff position, an over-thumb cuff position, a mitten position, and a trigger-finger position;

wherein the mitten is configured to be worn on a hand of a user-wearer and the sleeve is configured to be worn on a forearm portion of the user-wearer;

wherein the mitten comprises:

a palm panel having an inner palm layer and an outer palm layer, wherein the inner and outer palm layers are joined via a seam fastener to form a double palm layer;

wherein the inner and outer palm layers each have a thumb slot configured to receive a thumb therethrough in the over-thumb cuff position;

wherein the palm panel is joined via a seam fastener to the sleeve at a proximal end and to a finger panel at a distal end;

the finger panel having a first inner finger layer, a second inner finger layer, a first outer finger layer, and a second outer finger layer;

wherein the finger panel is folded over the palm panel in the cuff position and folded down from the palm panel in the over-thumb cuff position;

wherein the second outer finger layer is joined via a seam fastener along a fingertip seam, wherein the second outer finger layer is repositionable over the fingertips of the user-wearer to transition between the over-thumb cuff position and a partial mitten position;

wherein in the partial mitten position, the thumb sleeve is configured to prevent access to a thumb;

a thumb sleeve comprising an opening adjacent to a thumb opening and disposed on an exterior side of the outer palm layer;

wherein the thumb sleeve is adapted to reposition between a stored position and a working position, wherein in the working position, the opening of the thumb sleeve is positioned adjacent to the thumb opening and is configured to receive the thumb therein, wherein in the stored position, the thumb sleeve is folded over the exterior side of the outer palm layer;

wherein the thumb sleeve comprises a first mating fastener configured to removably fasten to a second mating fastener disposed on the exterior side of the outer palm layer, wherein the thumb sleeve is held in the stored position;

wherein in the mitten position, is configured to receive the thumb the thumb sleeve and the second outer layer is configured to be disposed over the fingertips of the user-wearer;

wherein the finger panel comprises a trigger finger hole configured to receive one or more fingers of the user-wearer therethrough in the trigger-finger position.

* * * * *